US005616231A

United States Patent [19]

Askin et al.

[11] Patent Number: 5,616,231

[45] Date of Patent: Apr. 1, 1997

[54] ELECTROBRIGHTENING PROCESS FOR ALUMINUM ALLOYS

[75] Inventors: Albert L. Askin, Lower Burrell; Paul B. Schultz, Murrysville; Daniel L. Serafin, Wexford, all of Pa.

[73] Assignee: Aluminum Company of America, Pittsburgh, Pa.

[21] Appl. No.: 646,460

[22] Filed: May 8, 1996

[51] Int. Cl.[6] ..... C25F 3/20; C23F 3/03

[52] U.S. Cl. ..... 205/153; 205/213; 205/680; 205/682; 205/704; 252/79.2

[58] Field of Search ..... 205/213, 674, 205/677, 682, 680, 704, 153; 252/79.2

[56] References Cited

U.S. PATENT DOCUMENTS

| | | | |
|---|---|---|---|
| 2,348,359 | 5/1944 | Pray | 205/680 X |
| 4,126,483 | 11/1978 | Donakowski et al. | 134/3 |
| 4,131,523 | 12/1978 | Faul et al. | 205/674 |
| 4,247,378 | 1/1981 | Harris | 205/682 |
| 4,483,750 | 11/1984 | Powers et al. | 205/213 X |
| 4,836,889 | 6/1989 | Suzuki et al. | 252/79.2 X |
| 4,995,951 | 2/1991 | Venn | 205/682 X |
| 5,066,370 | 11/1991 | Andreshak et al. | 205/680 X |
| 5,102,508 | 4/1992 | Bartkowski et al. | 205/173 |
| 5,290,424 | 3/1994 | Mozelewski et al. | 205/116 |
| 5,380,408 | 1/1995 | Svensson | 205/680 X |
| 5,417,819 | 5/1995 | Askin et al. | 205/661 X |

OTHER PUBLICATIONS

Wernick et al., *The Surface Treatment and Finishing of Aluminum and its Alloys,* vol. 1, Fifth Ed., pp. 73–81; 151–153, (1987).

*Primary Examiner*—Donald R. Valentine
*Attorney, Agent, or Firm*—Glenn E. Klepac

[57] ABSTRACT

Aluminum alloy articles are electrobrightened in an acidic solution containing phosphoric acid, water, and suspended mineral particles. The solution preferably also contains sulfuric acid. Aluminum alloy sheet electrobrightened in the solution has a less directional appearance when the suspended mineral particles are present.

17 Claims, No Drawings

ELECTROBRIGHTENING PROCESS FOR ALUMINUM ALLOYS

TECHNICAL FIELD

The present invention relates to processes for electrobrightening aluminum alloy surfaces to make them highly reflective. More particularly, the invention relates to an electrobrightening bath composition that results in an improved surface appearance on aluminum alloy articles.

BACKGROUND OF THE INVENTION

Although aluminum is ordinarily considered as having a bright appearance, it often presents a dull or matte-like surface finish resulting from the operations employed to shape it into useful articles. Such operations include rolling, casting, forging, extrusion and the like. For some uses, a substantially mirror-like surface finish is desirable. As used herein, the term "mirror-like" means that the surface has a high distinctness of image ("D/I" for brevity). D/I is the sharpness of a reflected image as measured by the ratio of reflectance at 0.3° from specular to the reflectance at the specular angle, that is, $$D/I=(R_S-R_{0.3})/R_s\times 100\%$$

wherein $R_s$ is the specular reflectance and $R_{0.3}$ is the reflectance at 0.3° from the specular angle. D/I=0 for a perfect diffuser and D/I=100 for a perfect mirror. As used herein, the term "substantially mirror-like" refers to a sheet surface having a D/I of at least 75% and preferably at least 80%.

Numerous chemical and electrochemical solutions have been developed in the prior art for polishing the surfaces of aluminum articles. However, none of the prior art solutions is completely satisfactory for its intended purpose. For example, one problem with prior art electrobrightening solutions is that they often produce a surface that is highly directional. As used herein, the term "directional" means that surface appearance of an electropolished aluminum alloy article is adversely affected by fine streaks in the rolling direction of the metal.

Askin et al. U.S. Pat. No. 5,417,819 states that an AA 5657 alloy aluminum plate was electrobrightened using a solution called ELECTROPOL 100, commercially available from Albright & Wilson of Richmond, Va. The ELECTROPOL 100 solution contains phosphoric acid and sulfuric acid, but not salts of sodium or potassium.

Bartkowski et al. U.S. Pat. No. 5,102,508 discloses a method of producing colored surfaces on aluminum automobile parts. In one example, an extruded section of an Al—Mg or Al—Mg—Si alloy article was mechanically ground and polished, then degreased and cleaned. The section was then subjected to electrolytic alkaline brightening in order to obtain a bright, reflective surface. The electrolyte contained 120 g/L trisodium phosphate, 330 g/L sodium carbonate, 10 g/L aluminum phosphate and beechwood extracts. Electrolysis conditions were 3 amp/dm$^2$ current density, 70°–80° C. operating temperature and 18 minutes exposure time. Additional processing steps resulted in a gold-bronze color or various other shades of bronze.

Wernick et al. described a Brytal process developed in 1936 in their book entitled *The Surface Treatment and Finishing of Aluminum and its Alloys* (1987). The Brytal electropolishing process employed an alkaline solution containing 12–20 wt. % anhydrous sodium carbonate and 2.5–7.5 wt. % trisodium phosphate. Bath temperature was 75°–90° C. and voltage was 7–16 volts.

A principal objective of the present invention is to provide an electrobrightening process for aluminum alloy articles that results in a less directional surface appearance than prior art electrobrightening processes.

A related objective of the invention is to provide an electrobrightening bath for the process of the invention.

Additional objectives and advantages of our invention will become apparent from the following detailed description.

SUMMARY OF THE INVENTION

In accordance with the present invention, there is provided a process for electrobrightening surfaces of aluminum alloy articles to make them more mirror-like. Such surfaces are desirable for aluminum alloy lighting sheet and are also useful on other articles such as automotive trim, appliance trim and aerospace sheet.

Aluminum alloy articles of the invention contain about 90% or more aluminum, together with one or more alloying elements that are not inconsistent with reflectivity. Aluminum alloys of the 5000 series (Aluminum Association designation) containing about 0.5–10 wt. % magnesium are preferred, especially the AA 5000 series alloys containing about 1.5 wt. % or less magnesium. Other suitable materials include aluminum alloys of the AA 1000 series; the AA 2000 series (containing about 2–7 wt. % copper); the AA 3000 series (containing about 0.15–2 wt. % maganese); the AA 6000 series (containing about 0.25–2 wt. % silicon and about 0.5–2 wt. % magnesium) and the AA 7000 series (containing about 0.5–10 wt. % zinc). Some particularly preferred alloys include the 1050, 1085, 1100, 3003, 3004, 3005, 5005, 5050 and 5657 aluminum alloys (AA series).

A particularly preferred AA 5657 alloy contains about 0.6–1.0 wt. % Mg, 0.08 wt. % max Si, 0.10 wt. % max Fe, 0.10 wt. % max Cu, 0.03 wt. % max Mn, 0.05 wt. % max Zn, 0.05 wt. % max other alloying elements and impurities, and remainder Al.

A preferred AA 5657 alloy sheet has a thickness of about 0.010–0.072 inch, preferably about 0.01 5–0.025 inch. The sheet preferably has an average surface roughness of about 13 microinches or less, more preferably a bright-rolled finish with average surface roughness about 3 microinches or less.

The aluminum alloy sheet in its as-rolled condition generally retains a lubricant film residue. Accordingly, the sheet is initially immersed in an acidic or alkaline cleaning bath to remove that residue. A preferred alkaline cleaning solution is sold under the name "Novaclean 120".

At least one surface of the sheet is polished by electrobrightening in the acidic solution of the present invention. The electrobrightened sheet surface is preferably desmutted, usually in an acidic bath. After desmutting, a protective coating may be applied, such as by anodizing and sealing. If desired, the anodized surface may be dyed to impart a specific color before sealing.

The preferred electropolishing solution is maintained at temperature of about 90°–150° F., preferably about 120°–140° F. The voltage applied to the sheet may range between 5 and 50 volts and is preferably about 15–45 volts. The solution has a pH of about 6 or less, preferably about 3 or less and more preferably about 0–3.

The electropolishing solution of the invention contains phosphoric acid, water and suspended mineral particles. Preferably, the solution also contains sulfuric acid. Although the exact proportions of phosphoric acid and sulfuric acid in our preferred solution are not critical, the solution should contain more phosphoric acid than sulfuric acid. The solution should be sufficiently concentrated that total water content is less than about 35 vol. %, preferably about 29–34 vol. %. The solution contains about 50–70 vol. % phosphoric acid, preferably about 55–65 vol. %. Sulfuric acid content is about 8–15 vol. %, preferably about 9–13 vol. %. The solution also contains suspended mineral particles. We have found that particles of pumice, activated carbon and silica are effective. A similar effect is also produced by adding sodium carbonate, potassium carbonate, sodium sulfate and potassium sulfate to the solution in amounts sufficient to cause a visible precipitate. For example, a preferred solution is made by adding at least about 90 g/L sodium carbonate and more preferably at least about 100 g/L.

The solution should contain little or no dissolved aluminum at the onset of electrobrightening, preferably about 10 g/L or less and more preferably about 0–8 g/L. An aluminum content of 15 g/L or more in the electrobrightening solution is detrimental to the appearance of aluminum alloy sheet treated by our process.

After the sheet surface is electrobrightened, it may be desmutted in an aqueous acidic solution. A suitable desmutting solution contains about 10–100 vol. % nitric acid, 0–60 vol. % sulfuric acid, 0–50 vol. % water and at least about 15 g/L of a source of fluoride, preferably ammonium bifluoride. Other suitable fluorides include hydrofluoric acid, sodium fluoride, potassium fluoride, sodium bifluoride and potassium bifluoride. A particularly preferred solution contains about 35 vol. % nitric acid, 25 vol. % sulfuric acid, 10 vol. % phosphoric acid, 30 vol. % water and 60 g/L ammonium bifluoride. The desmutting solution is preferably maintained at a temperature of about 60°–110° F.

DETAILED DESCRIPTION OF A PREFERRED EMBODIMENT

An electrobrightening solution was made up of the following ingredients: 75 wt. % phosphoric acid (85 wt. % concentration), 15 wt. % sulfuric acid (98 wt. % concentration) and 10 wt. % water. The solution was maintained at a temperature of 130° F. and initially it contained no dissolved aluminum. The following Table shows the effect on appearance of a 5000-series aluminum alloy sheet at various additions of sodium carbonate, with a treatment time of one minute.

TABLE

Effect of Sodium Carbonate on Sheet Appearance

| Sodium Carbonate Addition (g/L) | Voltage | Amperage | Result |
|---|---|---|---|
| 70 g/L | 30 volts | 19 amps | Slight directional appearance |
| 80 g/L | 30 volts | 23 amps | Very slight directional appearance |
| 90 g/L | 30 volts | 25 amps | Very slight directional appearance |
| 100 g/L | 30 volts | 30 amps | No directional appearance |
| 120 g/L | 30 volts | 36 amps | No directional appearance |
| 130 g/L | 30 volts | 38 amps | No directional appearance |

Although all samples were electrobrightened at the same applied voltage (30 volts), the amperage increased as the amount of added sodium carbonate increased. With 70–120 g/L added sodium carbonate, the solution was clear to slightly cloudy. When the amount of added sodium carbonated was above 80 g/L, there was a noticeable sodium sulfate precipitate.

Increasing the total concentration of water in the range of 29–34 vol. % had no effect on sheet appearance. At 35–40 vol. % the sheet had a slight directional appearance. These concentrations include water contributed by the acids.

Concentrations of dissolved aluminum in the range of 0–8 g/L all resulted in no directional appearance. At 10 g/L there was a slight directional appearance and at 15 g/L there was a very distinctive directional appearance.

Instead of sodium carbonate, we added to the solution various concentrations of sodium sulfate and sodium nitrate. Sodium sulfate had an effect on directionality similar to sodium carbonate. However, at a sodium sulfate concentration of 110 g/L the amperage was only 30 amps compared with 33 amps for sodium carbonate.

Sodium nitrate was added to the solution at a concentration of 110 g/L. The amperage increase was comparable to sodium carbonate but the surface was severely pitted.

In three separate experiments, we also added to the solution 100 g/L of the following mineral particles: pumice, silica and activated carbon. The particles were kept in suspension by constant stirring. The pumice particles gave a nice, non-directional appearance similar to sodium carbonate. At 30 volts, the current increased to 38 amps. Silica particles (240 mesh size) also produced a non-directional appearance. The current increased to 35 amps at 30 volts. Addition of activated carbon particles also gave a non-directional appearance. The current increased to 42 amps at 30 volts.

A solution was prepared containing phosphoric acid, acetic acid, ethylene glycol and 29 vol. % water. Sodium carbonate was added as above and an aluminum alloy sheet was electrobrightened. Sodium carbonate dissolved in the solution, but there was no improvement in directionality and no increase in amperage. No precipitate formed. We also added to the solution 100 g/L of the following: sodium sulfate, sodium phosphate, pumice and silica particles. These additions also failed to remove directionality from the sheet or to increase the amperage.

We have described our invention with reference to some particularly preferred embodiments thereof. Persons skilled in the art will understand that numerous changes and modifications can be made in the invention without departing from the spirit and scope of the following claims.

We claim:

1. A process for polishing a surface of an aluminum alloy article, comprising electrobrightening said surface at a temperature of about 90°–150° F. and at a voltage of about 5–50 volts in an acidic solution made by mixing together phosphoric acid, water, and suspended mineral particles.

2. A process of claim 1 wherein said mineral particles are formed by adding to the solution a substance selected from the group consisting of silica, activated carbon, pumice, sodium carbonate, potassium carbonate, sodium sulfate and potassium sulfate.

3. A process of claim 1 wherein said solution contains less than about 35 vol. % water.

4. A process of claim 1 wherein said solution contains about 29–34 vol. % water.

5. A process of claim 1 wherein said solution has a temperature of about 120°–140° F.

6. A process of claim 1 wherein said aluminum alloy article comprises a sheet having a thickness of about 0.010 to 0.072 inch.

7. A process of claim 1 wherein said aluminum alloy article comprises an aluminum alloy of the AA 1000, 3000 or 5000 series.

8. The process of claim 1, wherein addition of said mineral particles to said solution increases the current in said solution.

9. A process for forming a highly reflective surface on an aluminum alloy article comprising:

a) cleaning a surface of said article, b) polishing said surface in accordance with the electrobrightening process of claim 1, c) desmutting said surface in an acid bath, and d) applying a protective coating to said surface.

10. A process of claim 9 wherein step (d) comprises anodizing and sealing said surface.

11. The process of claim 1 wherein said solution contains at least about 10 g/L suspended mineral particles.

12. The process of claim 1 wherein said solution comprises about 50–70 vol. % phosphoric acid, about 8–15 vol. % sulfuric acid, about 29–34 vol. % water and at least about 10 g/L of suspended mineral particles.

13. The process of claim 1 wherein said solution comprises about 55–65 vol. % phosphoric acid, about 9–13 vol. % sulfuric acid and about 29–34 vol. % water.

14. A solution suitable for electrobrightening an aluminum alloy article comprising:

a) about 50–70 vol. % phosphoric acid, b) about 8–15 vol. % sulfuric acid, c) about 29–34 vol. % water, and d) at least about 10 g/L of suspended mineral particles comprising a substance selected from the group consisting of silica, activated carbon, pumice, sodium carbonate, potassium carbonate, sodium sulfate and potassium sulfate.

15. The solution of claim 14, comprising about 55–65 vol. % phosphoric acid, 9–13 vol. % sulfuric acid and 29–34 vol. % water.

16. The solution of claim 14, made by adding about 90–120 g/L sodium carbonate or sodium sulfate or a mixture thereof to said solution.

17. The solution of claim 14, having a pH of about 6 or less.

* * * * *